US011614221B2

(12) United States Patent
Yan et al.

(10) Patent No.: US 11,614,221 B2
(45) Date of Patent: Mar. 28, 2023

(54) LAMP

(71) Applicant: Hangzhou Hangke Optoelectronics Co., Ltd., Hangzhou (CN)

(72) Inventors: Qianjun Yan, Hangzhou (CN); Zhaozhang Zheng, Hangzhou (CN); Lingli Ma, Hangzhou (CN)

(73) Assignee: Hangzhou Hangke Optoelectronics Co., Ltd., Hangzhou (CN)

( * ) Notice: Subject to any disclaimer, the term of this patent is extended or adjusted under 35 U.S.C. 154(b) by 0 days.

(21) Appl. No.: 17/644,947

(22) Filed: Dec. 17, 2021

(65) Prior Publication Data

US 2023/0016159 A1 Jan. 19, 2023

(30) Foreign Application Priority Data

| | | |
|---|---|---|
| Jul. 7, 2021 | (CN) | 202121542607.4 |
| Jul. 7, 2021 | (CN) | 202121543596.1 |
| Sep. 14, 2021 | (CN) | 202122222173.6 |
| Sep. 14, 2021 | (CN) | 202122264737.2 |

(51) Int. Cl.
*F21V 19/00* (2006.01)
*F21V 23/00* (2015.01)
*F21Y 115/10* (2016.01)

(52) U.S. Cl.
CPC ..... *F21V 19/0015* (2013.01); *F21V 23/003* (2013.01); *F21Y 2115/10* (2016.08)

(58) Field of Classification Search
CPC ..... F21V 19/0015; F21V 23/003
USPC ..... 362/216
See application file for complete search history.

(56) References Cited

U.S. PATENT DOCUMENTS

| | | | | |
|---|---|---|---|---|
| 8,562,177 | B2 * | 10/2013 | Kajiya | H05K 1/189 362/249.04 |
| 10,690,292 | B1 * | 6/2020 | Cao | F21V 29/70 |
| 2011/0204777 | A1 * | 8/2011 | Lenk | H01K 1/64 315/32 |
| 2013/0265796 | A1 * | 10/2013 | Kwisthout | F21V 23/003 362/558 |
| 2016/0041324 | A1 * | 2/2016 | Nava | F21V 29/773 362/311.01 |
| 2017/0012177 | A1 * | 1/2017 | Trottier | F21K 9/00 |
| 2017/0227167 | A1 * | 8/2017 | Lai | F21V 29/503 |
| 2018/0031218 | A1 * | 2/2018 | Knapp | F21K 9/238 |
| 2020/0332962 | A1 * | 10/2020 | Chen | F21K 9/232 |

* cited by examiner

*Primary Examiner* — Bryon T Gyllstrom
(74) *Attorney, Agent, or Firm* — Schwegman Lundberg & Woesner, P.A.

(57) ABSTRACT

A lamp is provided, it includes a lamp body, a light-transmitting part, a light source and a power supply component. The lamp body includes a lamp base, the light source is mounted between the lamp base and the light-transmitting plate or mounted in a first cavity between the light-transmitting part and the lamp base, and the light source includes a filament which includes a power supply end electrically connected with the power supply component. The filament includes a plurality of LED chips connected in series, in parallel or in a mixed series-parallel manner. The filament or part of the filament is not in direct contact with the lamp base. Shapes of the light source of the lamp disclosed by the application varies, with better lighting effect and more design freedom at the same time.

19 Claims, 8 Drawing Sheets

LAMP

CROSS-REFERENCE TO RELATED APPLICATIONS

This Non-provisional application claims priority under 35 U.S.C. § 119(a) to Chinese Patent Application No. 202121542607.4, filed on Jul. 7, 2021, to Chinese Patent Application No. 202121543596.1, filed on Jul. 7, 2021, to Chinese Patent Application No, 202122222173.6, filed on Sep. 14, 2021, and to Chinese Patent Application No. 202122264737.2, filed on Sep. 14, 2021, the entire contents of each of which are hereby incorporated by reference in their entirety.

TECHNICAL FIELD

The disclosure relates to a technical field of illuminating lamps, in particular to a lamp.

BACKGROUND ART

A traditional LED lamp generally simply replaces a light source used by the lamp with a LED light source. If the LED light source is arranged in the lamp base, a lens is provided at an opening of the lamp base from which the LED lamp can irradiate. However, there are defects such as: glaring, unchangeable shape of the light source and less designability. Alternatively, some of the LED light sources are arranged on the lamp base, and meanwhile, for aesthetic purposes, an opalescent translucent lampshade is used to shielding an internal structure. This type of lamp presents a single style and unchangeable structural design. Only by designing a lampshade structure of the lamp can an appearance configuration be changed.

SUMMARY

In view of shortcomings in the prior art, the disclosure provides a lamp with a changeable light source shape and good lighting effect.

In order to solve the above technical problems, the present disclosure provides following technical solutions.

A lamp includes a lamp body, a light-transmitting part and a light source. The light-transmitting part is mounted to the lamp body, and the lamp body includes a lamp base, the light source is mounted between the lamp base and the light-transmitting part directly or mounted in a first cavity formed between the light-transmitting part and the lamp base, and the light source includes at least one filament which is completely or partially suspended relative to the lamp base.

Optionally, the light source includes one or more of a straight rod structure, a curved structure, a bent structure, a spiral structure and a winding structure.

Optionally, the light source is of a three-dimensional structure.

Optionally, the light source includes one or more of a straight rod structure, a curved structure, a bent structure, a spiral structure and a winding structure composed of one filament; or the light source includes one or more of a straight rod structure, a curved structure, a bent structure, a spiral structure and a winding structure composed of two or more than two filaments.

Optionally, the lamp also includes a bracket, and the filament is suspended or partially suspended and fixed between the lamp base and the light-transmitting part or in the first cavity by the bracket.

Optionally, the filament is fixed to the lamp base, all of the filament is fixed to the lamp base, or part of the filament is fixed to the lamp base.

Optionally, the bracket includes a first bracket which is connected with and fixes the filament, with an end of the filament being fixed to the lamp base.

Optionally, the bracket comprises a first bracket and a second bracket, an end of the second bracket is connected with the first bracket, and the other end thereof is connected with the filament.

Optionally, the bracket includes a first bracket and a second bracket, and the first bracket and the second bracket are independently fixed to the lamp base.

Optionally, the filament includes one or more than one luminescent particle and at least two sections of conductive components.

Optionally, the luminescent particle can be LED chips or LED lamp beads.

Optionally, the filament further includes a substrate on which the luminescent particle is mounted.

Optionally, the substrate is a flexible substrate or a rigid substrate,

Optionally, the light source includes a driving circuit and a power supply end.

Optionally, the light source is connected with the driving circuit, and the driving circuit is mounted on the lamp body or located outside the lamp body.

Optionally, the driving circuit is mounted on the lamp base,

Optionally, a mounting part is mounted outside the lamp body.

Optionally, the lamp base includes a first bottom plate and a mounting part, the first cavity is arranged between the light-transmitting part and the first bottom plate, and the mounting part has a lamp fixing structure.

Optionally, a surface of the first bottom plate located in the first cavity is a reflective surface.

Optionally, the lamp base includes a first bottom plate and a second bottom plate, a second cavity is provided between the first bottom plate and the second bottom plate, and the first bottom plate and the second bottom plate are connected by a buckle.

Optionally, the buckle includes a stepper component.

Optional, the lamp is a downlight or ceiling lamp; when the lamp is the downlight, the light-transmitting part is a light-transmitting plate; and when the lamp is the ceiling lamp, the light-transmitting part is a light-transmitting lampshade.

The application has following beneficial effects:

(1) by applying a LED filament structure the lamp products, various more beautiful styles can be designed internally. When the light source is lit, a shape of the light source can be seen from outside of the light-transmitting part. Meanwhile, the light-transmitting part can also be designed to be transparent or translucent, so as to reveal a designed structure inside. Thereby forming a lamp structure incorporating in aesthetics and practicality. With this kind of structure, different styles can be made with the LED filament, and designers have higher design freedom, which is different from traditional lamps with a single internal structure.

(2) A flexible filament can be shaped by fixing the filament with a bracket. After the light source is powered on, the bracket for fixing the filament will be hidden due to effect of rays, and only a structure of the filament can be seen from the outside, which well solves influence of the bracket on aesthetics of the light source.

BRIEF DESCRIPTION OF THE DRAWINGS

In order to explain the embodiments of the present disclosure or the technical scheme in the prior art more clearly, the drawings required in the description of the embodiments or the prior art will be briefly introduced below; obviously, the drawings in the following description are only some embodiments of the present disclosure, and other drawings can be obtained according to these drawings by those of ordinary skill in the art without paying creative labor.

DETAILED DESCRIPTION

The present disclosure will be further described in detail with reference to the following examples which are explanation of the present disclosure and the present disclosure is not limited to the following examples.

Embodiment 1

Figure 1:
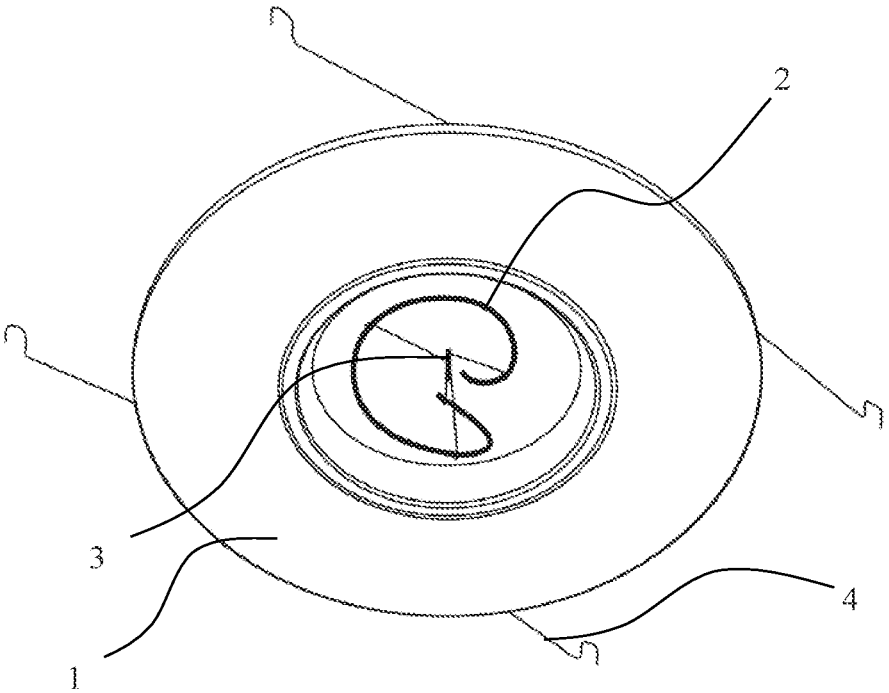
FIG. 1 is a structural diagram of a lamp disclosed in Embodiment 1.

The embodiment discloses a downlight, referring to FIG. 1, which includes a lamp body 1, a light-transmitting plate 5, a light source 2 and a power supply component. The lamp body includes a lamp base 6, the light source is mounted between the lamp base 6 and the light-transmitting plate 5, and the light source includes a filament which includes a power supply end electrically connected with the power supply component. The filament includes a plurality of LED chips or lamp beads connected in series, in parallel or in a mixed series-parallel manner. The filament or part of the filament is not in direct contact with the lamp base. The filament is in a suspended or partially suspended state. The light-transmitting plate is a light-transmitting diffusion plate of the downlight.

The filament or part of the filament is not in direct contact with the lamp base. It can also be understood that the filament is fixed to the lamp base, all of the filament is fixed to the lamp base, or part of the filament is fixed to the lamp base. The fixing include fixing with or without the bracket.

The light source includes one or more of a straight rod structure, a curved structure, a bent structure, a spiral structure and a winding structure composed of one filament; or the light source includes one or more of a straight rod structure, a curved structure, a bent structure, a spiral structure and a winding structure composed of two or more than two filaments.

The above scheme includes several implementations: 1) The light source includes one filament, which has a straight rod structure, a curved structure, a bent structure, a spiral structure or a winding structure as a whole.

2) The light source comprises one filament which is integrated with at least two structural forms of a straight rod structure, a curved structure, a bent structure, a spiral structure and a winding structure. For example, the filament is made into a filament with a straight rod structure and a spiral structure.

3) The light source includes two or more filaments, each filament can have a same structure or a different structure, and an electrical connection between the filaments provides different shapes. The shape is aesthetically pleasing.

The LED lamp bead in this case can be understood as including a granular substrate, an LED chip fixed on the granular substrate, a light-transmitting plastic layer or a colloidal layer covering the chip, and a light source with an exposed conductive end.

In other foreseeable embodiments, the filament may adopt a filament-like structure or a strip-like structure composed of an LED chip structure without a substrate and a conductive component.

Further, the filament also includes a protective layer, and luminescent particles are positioned in the light-transmitting protective layer; part or all of the conductive component are located in the light-transmitting protective layer. In this embodiment, the luminescent particles and the conductive component are both located in a light-transmitting protective layer to form a filament.

In this case, a substrate of the filament is a flexible substrate or a rigid substrate, the rigid substrate can be a PCB, a ceramic substrate, a glass substrate, a copper substrate or an aluminum substrate, and the flexible substrate can be a FPC substrate.

Figure 2:
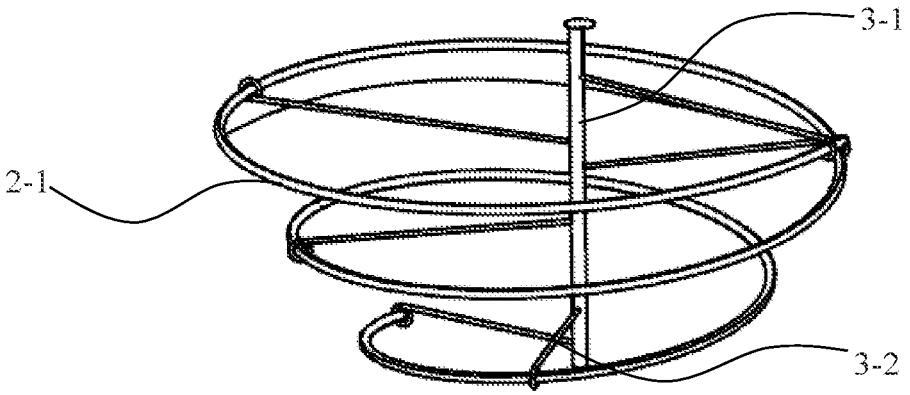
FIG. 2 is a schematic structural diagram of the light source in the lamp disclosed in Embodiment 1.

In this embodiment, as shown in FIG. 1, the light source includes at least one group of the above-mentioned filaments, and the at least one group of the above-mentioned filaments are in a curved, bent, spiral or winding state. FIG. 2 provides a spiral structure 2-1, one end of which is proximate to the lamp base, and the other end of which is proximate to the light-transmitting plate. In other embodiments, the light source can be formed by winding a filament. In an actual design, the filament may be used to design various aesthetic structures, which is not limited to this embodiment.

There are two ways to fix the filament structure in the curved, bent, spiral or winding state. Firstly, it is directly fixed to the lamp base, and a shapable substrate is required, which will not be deformed due to gravity after being set into the spiral structure, forming a partially suspended structure.

Secondly, all the filament structures are suspended and fixed, and a bracket is provided on the lamp base to realize suspending and fixing of the filament structures in a curved, bent, spiral or winding state. Specifically, a bracket 3 is fixed to the lamp base, and the bracket fixes the filament. The bracket includes a first bracket 3-1, specifically in a form of a straight rod, with one end being fixed to the lamp base and the other end being far away from the lamp base. The filament can be wound on the first bracket.

Further, in order to make the molding more diversified, a second bracket 3-2 may be provided. The second bracket is in a form of a plurality of elongate fixing wires, and one ends of the fixing wires are fixed to the first bracket and the other ends of the fixing wires are connected with the filament, so that the filament can be shaped by the plurality of fixing wires, and then different styles of light sources can be designed. The fixing wires can be copper wires, iron wires, nickel wires, molybdenum wires, ceramic rods, glass rods or plastic rods. The fixing wires can be rigid or semi-flexible (that is, it can be shaped), instead of being made of completely soft material.

Description of above technical characteristics that the light source is completely or partially suspended relative to the lamp base, taking the filament of the spiral structure as an example, can be constructed as that one end or one section of the filament of the spiral shape is fixed to the lamp base, and other parts thereof are suspended, fixed and shaped by the first bracket and the second bracket or only by the first bracket, that is, the parts are suspended.

Alternatively, all of the structure of the filament designed as the spiral structure are not in direct contact with the lamp base, and are suspended, fixed and shaped only by the first bracket and the second bracket, and a power supply end of the filament is connected to the lamp base through a conductive wire.

With regard to the bracket structure, in other conceivable embodiments, the first bracket and the second bracket are independently fixed to the lamp base. Two independent brackets fix the light source, which is specifically suspended or partially suspended. It can be understood that the number of the first bracket and the second bracket may be one or more.

The downlight disclosed in this embodiment further includes a driving circuit. In an embodiment, the driving circuit is integrated with the light source, that is, the driving circuit is configured on a filament, and the filament leads out of a power supply end A which can be directly connected with an alternating current.

In another embodiment, the light source is connected with a driving circuit, that is, the driving circuit is not integrated on the filament, the driving circuit is independent of the downlight, and the power supply terminal B of the filament is connected to the independent driving circuit through an electrical lead-out wire.

In another embodiment, the light source is connected with a driving circuit, that is, the driving circuit is not integrated on the filament, the driving circuit is mounted to the lamp base and the power supply terminal C of the filament is connected to the driving circuit of the lamp body.

The lamp body is provided with a light-transmitting plate, a light source and a lamp base. A mounting part is mounted outside the lamp body. The mounting part outside can be a plurality of groups of hooks, such as four groups of hooks 4 in FIG. 1. It can also be a buckle.

The LED filament structure is applied to downlight products for the purpose of design diversification, so selection of the light-transmitting plate is required to enable a structure of the internal light source to be observed. There are two kinds of applied structures for reference herein. In the first one, when the light source is not lit, the structure inside the light-transmitting plate cannot be seen, and when the light source is lit, a shape of the lit light source can be seen from the light-transmitting plate. In the second one, even when the light source is not lit, the internal light source structure can also be seen, and it can also be used as an ornamental lamp when it is not lit. Meanwhile, the light-transmitting plate can also be designed to be transparent or translucent, so as to reveal a designed structure inside. Thereby a downlight structure incorporating aesthetics and practicality is formed.

With this kind of structure, different styles can be made with the LED filament, and designers have higher design freedom, which is different from traditional downlights with a single internal structure, but a design of its external structure is greatly limited, because most of lamp bodies of the downlights are required to be embedded in a wall, the lamp bodies have fixed specifications. Therefore, starting from a light source design, a design of the downlight can be more diversified.

Embodiment 2

This embodiment discloses a downlight which is different from that in Embodiment 1 in a structure of the filament. Other components are same or similar, which can be understood with reference to Embodiment 1. The light source is COB light source, and the filament includes a plurality of LED chips connected in series, parallel or in a mixed series-parallel manner, as well as a conductive component and a substrate. Specifically, the substrate is provided with one or more than one LED chip and two or more than two sections of conductive components. The one or more than one LED chip is connected through the conductive component to realize a combined electrical connection mode of one or more than one LED chip in series, parallel or in a mixed series-parallel manner.

The substrate adopts a strip-shaped substrate or a spiral substrate, and the LED chip and the conductive components mounted on the strip-shaped substrate or the spiral substrate.

The filament also includes a protective layer, and the LED chip is positioned in the light-transmitting protective layer; part or all of the conductive component is located in the light-transmitting, protective layer. In this embodiment, the LED chips and the conductive component are both located in a light-transmitting protective layer so as to form a filament.

Because the substrate in this embodiment is the strip-shaped or spiral substrate, with a small width and an elongate shape. If necessary, both sides of the substrate are provided with the light-transmitting protective layer, or the whole substrate is located in the light-transmitting protective layer, so that an overall structure of the filament is more unified and beautiful.

In the above, the light-transmitting protective layer can be transparent, opaque or translucent, as long as it meets light-transmitting requirements. For example, a fluorescent glue can be used, which is not particularly limited.

Embodiment 3

Figure 3:
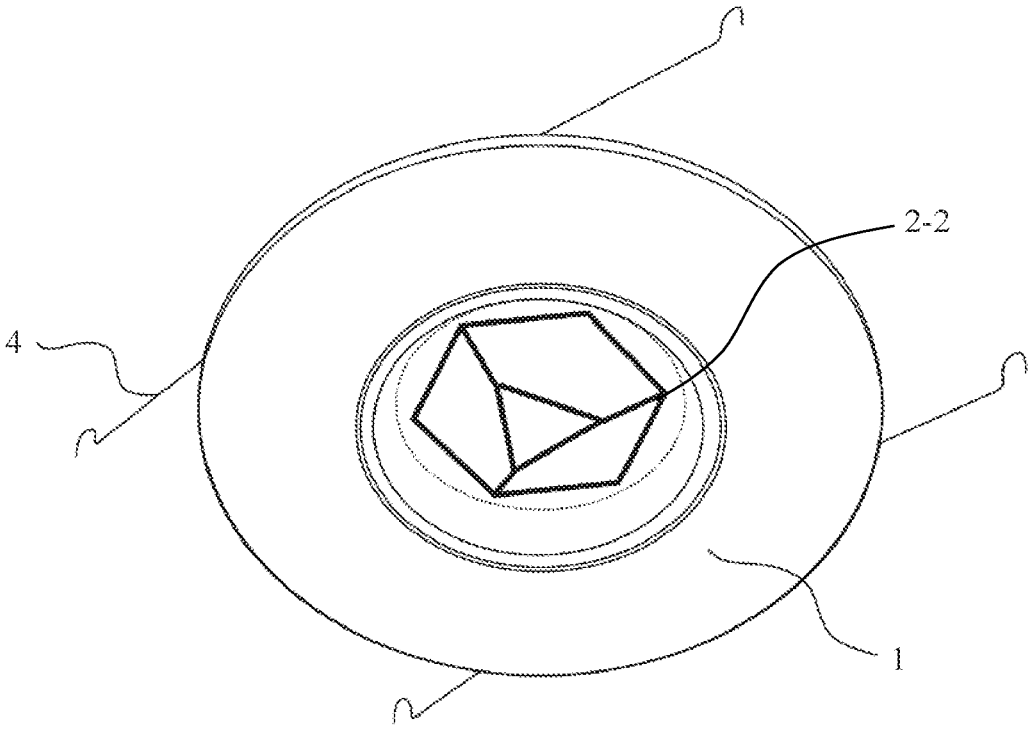
FIG. 3 is a structural diagram of the lamp disclosed in Embodiment 3.

This embodiment discloses a downlight, which is different from that is Embodiment 1 and Embodiment 2 in that, as shown in FIG. 3, the light source includes at least two groups of electrically connected filaments, and the at least two groups of filaments are combined to form a three-dimensional structure. Specifically, it is as follows:

The light source includes at least two groups of electrically connected filaments, and the at least two groups of filaments are combined to form a three-dimensional structure. The specific light source can include following implementations, and only part of structural examples are given here. According to actual needs, various light sources can be designed in structure according to idea of this scheme.

The light source is formed by combining a plurality of straight rod-shaped filaments, with the filaments are connected in series, in parallel or in a mixed series-parallel manner. Joints of the filaments are fixed so that all of the filaments connected together cannot be deformed.

As shown in FIG. 3, it can be seen that the light source is of a three-dimensional structure with a trapezoidal cross-section combined with a plurality of straight rod-shaped filaments 2-2, which includes a convex part which is arranged towards the light-transmitting plate.

Embodiment 4

Figure 4:
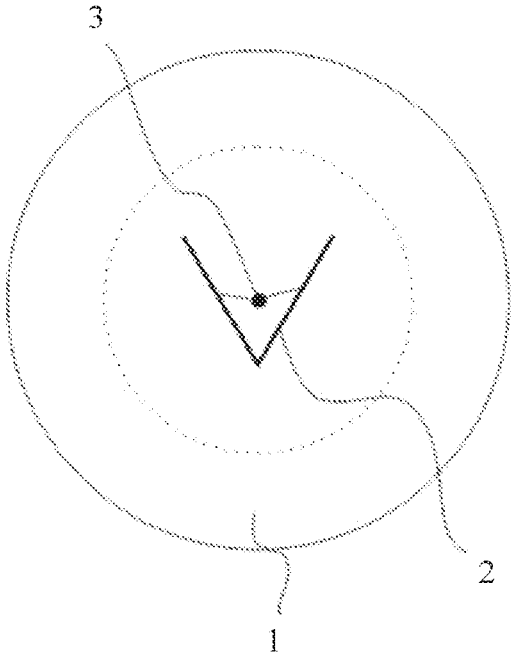
FIG. 4 is a structural diagram of the lamp disclosed in Embodiment 4.

This embodiment discloses a downlight. As shown in FIG. 4, a structure of this downlight is different from that in Embodiment 1 in that its light source 2 includes one filament with a curved structure.

Embodiment 5

Figure 5:
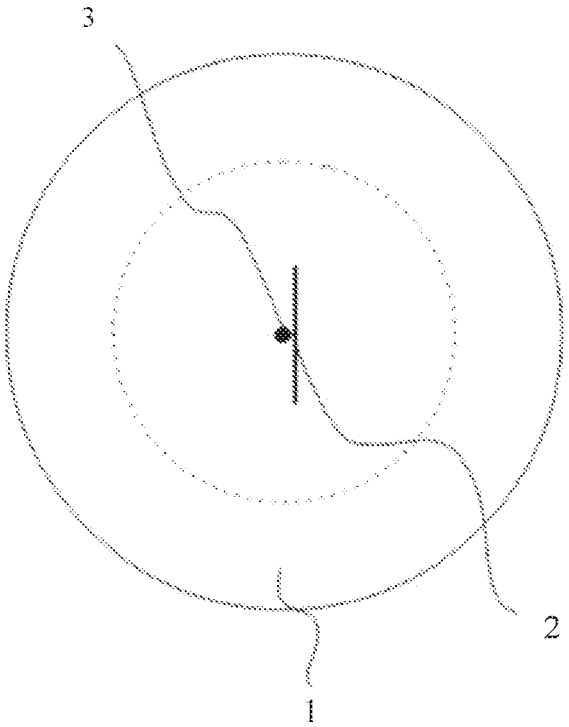
FIG. 5 is a structural diagram of the lamp disclosed in Embodiment 5.

This embodiment discloses a downlight. As shown in FIG. 5, a structure of this downlight is different from that in Embodiment 1 in that its light source 2 includes one filament which is a flexible filament and is stretched to be a straight rod structure. The flexible filament of this straight rod structure is fixed transversely or vertically or obliquely in space between the light-transmitting plate and the lamp base.

Other parts of the downlight are shown in Embodiment 1, and will not be described in detail here. Design and adjustment can be made by those skilled in the art according to the above.

In other embodiments, the downlight includes two, three, four or more filaments in a straight rod structure. A plurality of filaments with a straight rod structure are vertically or transversely or obliquely arranged between the light-transmitting plate and the lamp base.

Embodiment 6

Figure 6:
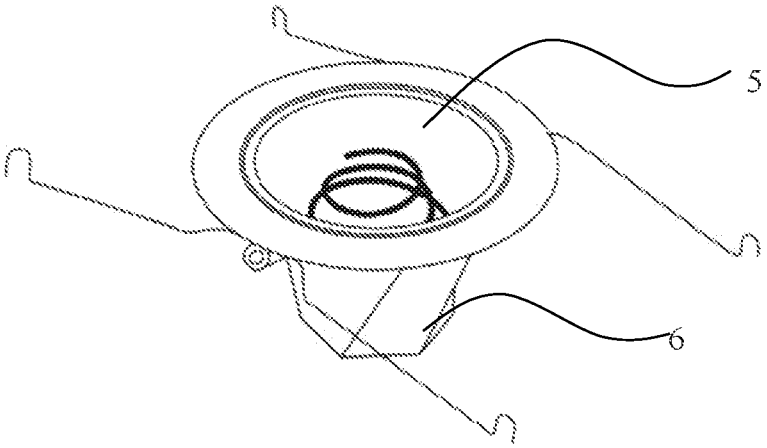
FIG. 6 is a structural diagram of the lamp disclosed in Embodiment 6.

In this embodiment, a downlight is disclosed, which does not use a bracket to fix the filament, and the filament is mounted in space between the light-transmitting plate and the lamp base. There are one or more filaments, each including one or more of a straight rod structure, a curved structure, a bent structure, a spiral structure and a winding structure. As shown in FIG. 6, taking a filament with a spiral structure as an example, a part of the filament with the spiral structure is fixed to the lamp base and directly fixed to the first cavity without a bracket, and the power supply end is connected to the lamp base.

In an embodiment, a part of the filament is fixed to the lamp base, and when the downlight is mounted to the wall, unfixed parts of the filament droop due to gravity, forming a uniquely designed downlight light source.

In another embodiment, the filament adopts a semi-flexible or rigid substrate, and when the filament is shaped in the first cavity, it will not be deformed due to the gravity.

The mounting method disclosed in Embodiment 6 can be applied to any one of the downlights in Embodiments 1-5, as long as the bracket in Embodiments 1-5 is replaced by the mounting method of this embodiment.

As to the filament, in an embodiment, the filament includes a plurality of LED chips connected in series, parallel or in a mixed series-parallel manner. Specifically, it includes one or more than one LED chip and two or more than two sections of conductive components. The one or more than one LED chip is connected through the conductive component to realize a combined electrical connection mode of one or more than one LED chip in series, parallel or in a mixed series-parallel manner.

The filament also includes a protective layer, and the LED chip is positioned in the light-transmitting protective layer; part or all of the conductive component is located in the light-transmitting protective layer. The LED chips and the conductive component are both positioned in the light-transmitting protective layer, so as to form the filament.

As to the filament, in another embodiment, based on embodiment 2, the light source is COB light source, and the filament includes a plurality of LED chips connected in series, parallel or in a mixed series-parallel manner, as well as a conductive component and a substrate. Specifically, the substrate is provided with one or more than one LED chip and two or more than two sections of conductive components. The one or more than one LED chip is connected through the conductive component to realize a combined electrical connection mode of one or more than one LED chip in series, parallel or in a mixed series-parallel manner.

The substrate adopts a strip-shaped substrate or a spiral substrate, and the LED chip and the conductive components mounted on the strip-shaped substrate or the spiral substrate.

Figure 7:
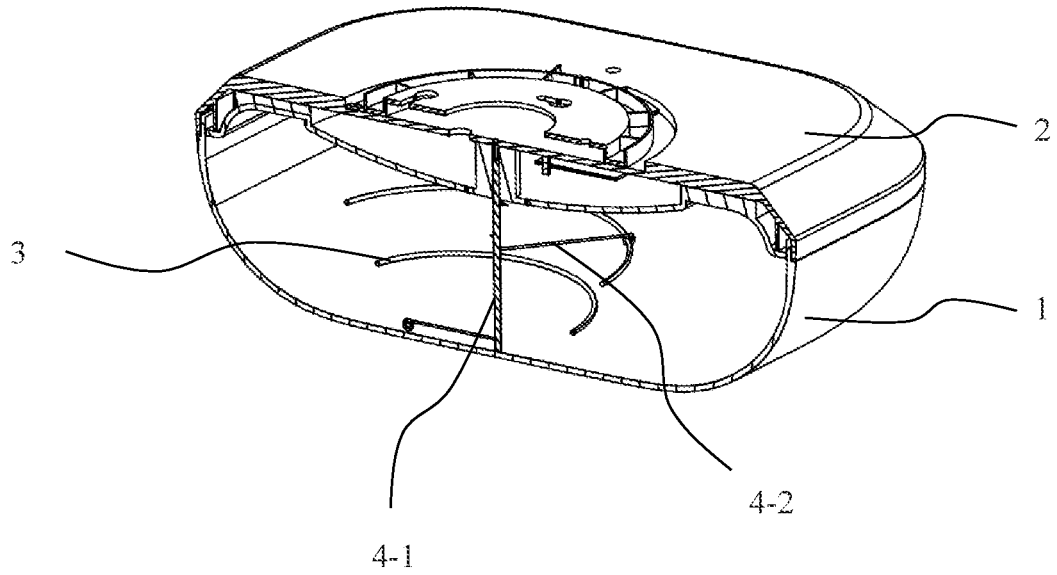
FIG. 7 is a sectional view of a ceiling lamp disclosed in Embodiment 7.

The application also provides another type of LED lamp, i.e. a ceiling lamp. Referring to FIG. 7, the light-transmitting part is a light-transmitting lampshade 1, the ceiling lamp includes a light-transmitting lampshade 1, a lamp base 2 and a light source 3. The light-transmitting lampshade is fixed to the lamp base. The light source is mounted in a first cavity between the light-transmitting lampshade and the lamp base, and includes at least one filament, and the light source includes one or more of a straight rod structure, a curved structure, a bent structure, a spiral structure and a winding structure. The light source is partially or completely suspended relative to the lamp base. The light source has a three-dimensional structure. The filament is fixed to the lamp base, all of the filament is fixed to the lamp base, or part of the filament is fixed to the lamp base. The fixing includes fixing with or without the bracket.

The light source includes one or more of a straight rod structure, a curved structure, a bent structure, a spiral structure and a winding structure composed of one filament; or the light source includes one or more of a straight rod structure, a curved structure, a bent structure, a spiral structure and a winding structure composed of two or more than two filaments.

The above scheme includes several implementations: 1) The light source includes one filament, which has a straight rod structure, a curved structure, a bent structure, a spiral structure or a winding structure as a whole.

2) The light source comprises one filament which is integrated with at least two structural forms of a straight rod structure, a curved structure, a bent structure, a spiral structure and a winding structure. For example, the filament is made into a filament with a straight rod structure and a spiral structure.

3) The light source includes two or more filaments, each filament can have a same structure or a different structure, and an electrical connection between the filaments provides different shapes. The shape is aesthetically pleasing.

For example, a combination of a plurality of filaments with a straight rod structure (Embodiment 10), such as a combination of one or more filaments with a straight rod structure and one or more filaments with a curved structure (Embodiment 9). For example, the filaments are arranged independently, i.e., at a spatial distance, or the filaments are connected, i.e., being in contact in space.

Specifically, the filament includes one or more than one luminescent particle and at least two sections of conductive components. The luminescent particles can be LED chips or LED lamp beads. That is, the luminescent particles can be LED chips directly fixed to the strip-shaped substrate or LED lamp beads fixed to the strip-shaped substrate. The LED lamp bead in this case can be understood as including a granular substrate, an LED chip fixed on the granular substrate, a light-transmitting plastic layer or a colloidal layer covering the chip, and a light source with an exposed conductive end.

In other foreseeable embodiments, the filament may adopt a filament-like structure or a strip-like structure composed of an LED chip structure without a substrate and a conductive component.

Further, the filament also includes a protective layer, and luminescent particles are positioned in the light-transmitting protective layer; part or all of the conductive component are located in the light-transmitting protective layer. In this embodiment, the luminescent particles and the conductive component are both located in a light-transmitting protective layer to form a filament.

In this case, a substrate of the filament is a flexible substrate or a rigid substrate, the rigid substrate can be a PCB, a ceramic substrate, a glass substrate, a copper substrate or an aluminum substrate, and the flexible substrate can be a FTC substrate.

Embodiment 7

Figure 8:
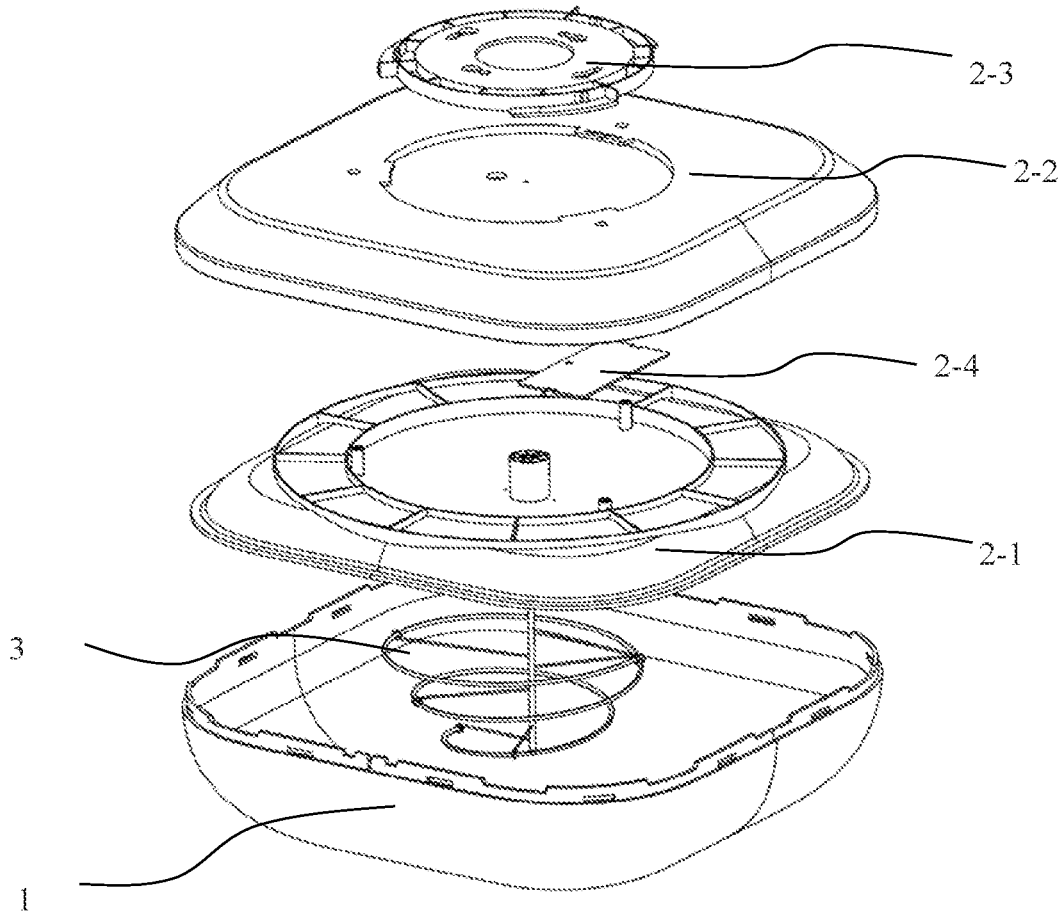
FIG. 8 is an exploded view of the ceiling lamp disclosed in Embodiment 7.

As shown in FIG. 7 and FIG. 8, in this embodiment, the light source is with one filament with a spiral structure, an end of the spiral structure is mounted proximate to the lamp base, and the other end of the spiral structure is proximate to a top of the light-transmitting lampshade.

The filament can be fixed in two ways. Firstly, it is directly fixed to the lamp base, and a shapable substrate is required, which will not be deformed due to gravity after being set into the spiral structure, forming a partially suspended structure. Second, the filament is suspended and fixed as a whole, and a bracket is provided on the lamp base to realize suspending and fixing of the filament (as shown in FIG. 7 and FIG. 8). Specifically, a bracket 4 is fixed to the lamp base, and the bracket fixes the filament. The bracket includes a first bracket 4-1, specifically in a form of a straight rod, with one end being fixed to the lamp base and the other end being far away from the lamp base.

The bracket also includes a second bracket 4-2. The second bracket is in a form of a plurality of elongate fixing wires, and one ends of the fixing wires are fixed to the first bracket and the other ends of the fixing wires are connected with the filament, so that the filament can be molded and shaped by the plurality of fixing wires, and then different styles of light sources can be designed. The fixing wires can be copper wires, iron wires, nickel wires, molybdenum wires, ceramic rods, glass rods or plastic rods. The fixing wires can be rigid or semi-flexible (that is, it can be molded and shaped), instead of being made of completely soft material.

Description of above technical characteristics that the light source is partially or completely suspended relative to the lamp base, taking the filament of the spiral structure as an example, can be constructed as that one end or one section of the filament of the spiral shape is fixed to the lamp base, and other parts thereof are suspended, fixed and shaped by the first bracket and the second bracket, that is, the parts are suspended.

Alternatively, all of the structure of the filament designed as the spiral structure are not in direct contact with the lamp base, and are suspended, fixed and shaped only by the first bracket and the second bracket, and a power supply end of the filament is connected to the lamp base through a conductive wire.

With regard to the bracket structure, in other conceivable embodiments, the first bracket and the second bracket are independently fixed to the lamp base. Two independent brackets fix the light source, which is specifically suspended or partially suspended. It can be understood that the number of the first bracket and the second bracket may be one or more.

The ceiling lamp disclosed in this embodiment further includes a driving circuit. In an embodiment, the driving circuit is integrated with the light source, that is, the driving circuit is configured on a filament, and the filament leads out of a power supply end A which can be directly connected with an alternating current.

In another embodiment, the light source is connected with a driving circuit, that is, the driving circuit is not integrated on the filament, the driving circuit is independent of the ceiling lamp, and the power supply terminal B of the filament is connected to the independent driving circuit through an electrical lead-out wire.

In another embodiment, the light source is connected with a driving circuit, that is, the driving circuit is not integrated on the filament, the driving circuit is mounted to the lamp base and the power supply terminal C of the filament is connected to the driving circuit of the lamp base.

The lamp base of the ceiling lamp includes a first bottom plate 2-1, a second bottom plate 2-2 and a mounting part 2-3. The first bottom plate and the second bottom plate are fixedly connected by a buckle; the second bottom plate is fixedly connected with the mounting part. A first cavity is formed between the light-transmitting lampshade and the first bottom plate. A second cavity is formed between the first bottom plate and the second bottom plate, and a power supply component 2-4 is mounted in the second cavity and is electrically connected with the conductive wire. The first bottom plate and the second bottom plate are connected by a buckle, and the buckle includes a stepper component.

Based on the above setting method of the driving circuit, the power supply component may or may not include the driving circuit.

Further, a surface of the first bottom plate located in the first cavity is a reflective surface. The reflective surface is used for reflecting light generated by that light source.

The LED filament structure is applied to ceiling lamp products for the purpose of design diversification, so selection of the light-transmitting lampshade is required to enable a structure of the internal light source to be observed. There are two kinds of applied structures for reference herein. In the first one, when the light source is not lit, the structure inside the light-transmitting lampshade cannot be seen, and when the light source is lit, a shape of the lit light source can be seen from outside the lampshade. In the second one, even when the light source is not lit, the internal light source structure can also be seen, and it can also be used as an ornamental lamp when it is not lit. Meanwhile, the light-transmitting lampshade can also be designed to be transparent or translucent, so as to reveal a designed structure inside. Thereby a ceiling lamp structure incorporating aesthetics and practicality is formed.

With this kind of structure, different styles can be made with the LED filament, and designers have higher design freedom, which is different from traditional ceiling lamps with a single internal structure. Only by changing a pattern and shape of the light-transmitting lampshade can an aesthetic design be made.

Embodiment 8

Figure 9:
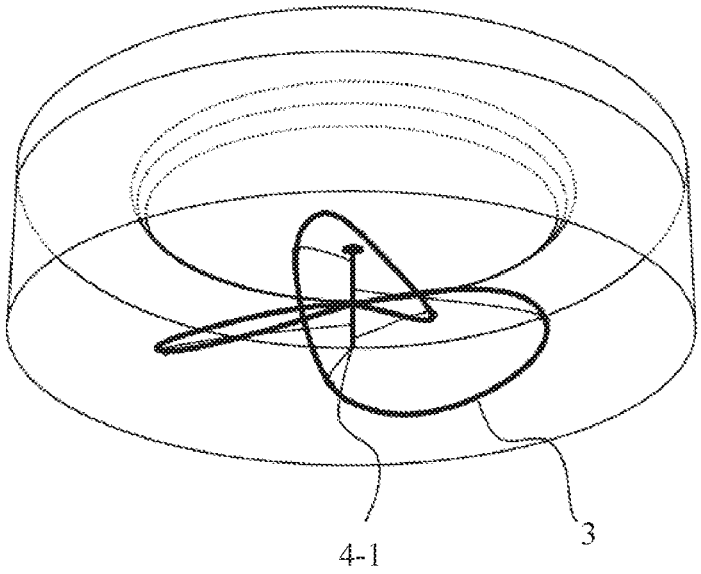
FIG. 9 is a schematic diagram of a ceiling lamp disclosed in Embodiment 8.

This embodiment discloses a ceiling lamp, a structure of the ceiling lamp is different from that in Embodiment 7 in that its light source includes one filament with a winding structure. Referring to FIG. 9, the light source 3 can be formed by winding a filament. In an actual design, the filament may be used to design various aesthetic winding structures, which is not limited to this embodiment.

There are two methods for fixing the filament of this winding structure, and one of the two methods is similar to that in Embodiment 7, and includes a straight rod-shaped first bracket 4-1 and a second bracket, and the filament is fixed by the first bracket and the second bracket (referring to Embodiment 7 for structures of the first bracket and the second bracket).

In another embodiment, the filament of the winding structure may not be provided with a bracket, and one or more segments of the filament may be fixed to the lamp base, and portions of the filament not contacting the lamp base may be placed in the first cavity in a winding state.

Embodiment 9

Figure 10:
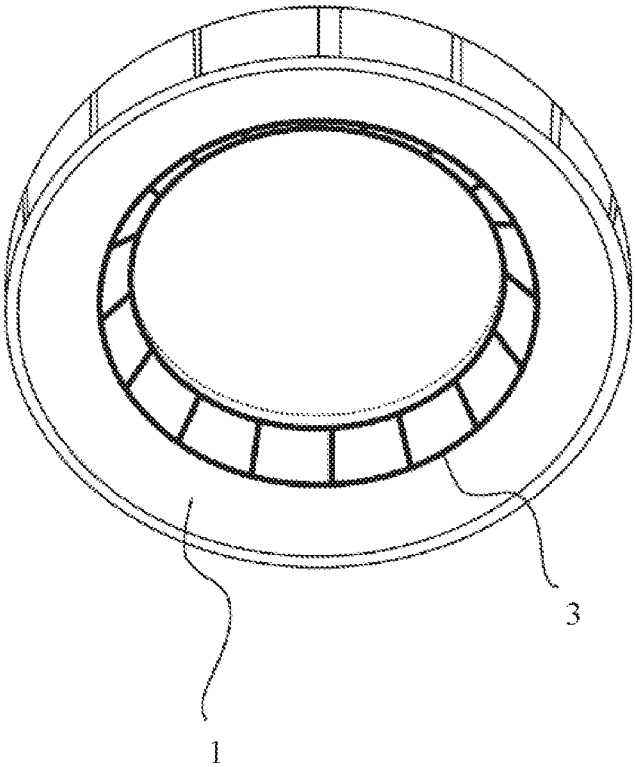
FIG. 10 is a schematic diagram of a ceiling lamp disclosed in Embodiment 9.

The embodiment discloses a ceiling lamp, a structure of the ceiling lamp is different from that in Embodiment 7 in that, as shown in FIG. 10, the light source 3 includes at least two electrically connected filaments, and the at least two filaments are combined to form a three-dimensional structure.

The light source combines a plurality of short filaments and two long filaments to be an annular structure. The long filaments have a curved structure.

As to the filament, in an embodiment, the filament includes a plurality of LED chips connected in series, parallel or in a mixed series-parallel manner. Specifically, it includes one or more than one LED chip and two or more than two sections of conductive components. The one or more than one LED chip is connected through the conductive component to realize a combined electrical connection mode of one or more than one LED chip in series, parallel or in a mixed series-parallel manner.

The filament also includes a protective layer, and the LED chip is positioned in the light-transmitting protective layer; part or all of the conductive component is located in the light-transmitting protective layer. The LED chips and the conductive component are both positioned in the light-transmitting protective layer, so as to form the filament.

In this embodiment, the light source is COB light source, and the filament includes a plurality of LED chips connected in series, parallel or in a mixed series-parallel manner, as well as a conductive component and a substrate. Specifically, the substrate is provided with one or more than one LED chip and two or more than two sections of conductive components. The one or more than one LED chip is connected through the conductive component to realize a combined electrical connection mode of one or more than one LED chip in series, parallel or in a mixed series-parallel manner.

The substrate adopts a strip-shaped substrate or a spiral substrate, and the LED chip and the conductive components mounted on the strip-shaped substrate or the spiral substrate.

Referring is made to the disclosure in Embodiment 7 for other technical features, which will not be repeated in this embodiment.

Embodiment 10

This embodiment discloses a ceiling lamp, a structure of the ceiling lamp is different from that in Embodiment 7 in that the light source includes at least two electrically connected filaments, and the at least two filaments are combined to form a three-dimensional structure. The specific light source can include following implementations, and only part of structural examples are given here. According to actual needs, various light sources can be designed in structure according to idea of this scheme.

The light source is formed by combining a plurality of straight rod-shaped filaments, with the filaments are connected in series, in parallel or in a mixed series-parallel manner. The two ends of each of the filaments are fixedly connected with ends of adjacent filaments. Joints of the filaments are fixed so that the filaments connected together cannot be deformed.

Figure 11:
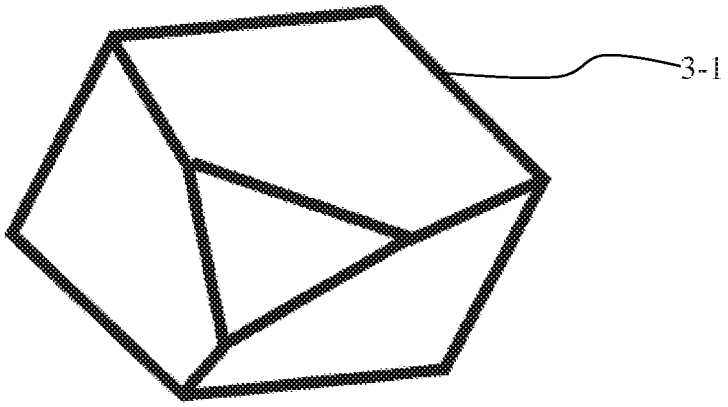
FIG. 11 is a schematic diagram of a light source structure of a ceiling lamp disclosed in Embodiment 10.

As shown in FIG. 11, it can be seen that the light source is a tower-shaped three-dimensional structure with a hexagonal bottom combined with a plurality of straight rod-shaped filaments 3-1, which includes a convex part which is arranged towards the light-transmitting plate.

Difference between this embodiment and Embodiment 10 is that the light source is formed by connecting two or more than two straight rod filaments. Specifically, it can be understood that a plurality of straight rod-shaped filaments is built into a three-dimensional structure, and the filaments are connected in series or in parallel, and connection nodes (ends) are fixed, so that the whole structure does not move and a stable three-dimensional structure is formed.

A side of the three-dimensional structure is fixed to the lamp base and the filament includes a power supply end which is led out and connected to the power supply component.

Embodiment 11

The embodiment discloses a ceiling lamp, referring to FIG. 7, which includes a light-transmitting lampshade 1, a lamp base 2, a light source 3 and a power supply component. The light-transmitting lampshade is fixed to the lamp base, and the light source is mounted between the light-transmitting lampshade and the lamp base; the light source includes at least one group of filaments, and the filament includes a power supply end electrically connected with the power supply component, and the filament is suspended or partially suspended, that is, the whole filament structure does not directly contact with the lamp base or part of the filament structure does not directly contact with the lamp base.

The light source is COB light source, and the filament includes a plurality of LED chips connected in series, parallel or in a mixed series-parallel manner, as well as a conductive component and a substrate. Specifically, the substrate is provided with one or more than one LED chip and two or more than two sections of conductive components. The one or more than one LED chip is connected through the conductive component to realize a combined electrical connection mode of one or more than one LED chip in series, parallel or in a mixed series-parallel manner.

The substrate adopts a strip-shaped substrate or a spiral substrate, and the LED chip and the conductive components mounted on the strip-shaped substrate or the spiral substrate. The spiral substrate can be understood as an elongated spiral substrate, which forms a strip-shaped filament after being packaged.

The filament also includes a protective layer, and the LED chip is positioned in the light-transmitting protective layer; part or all of the conductive component is located in the light-transmitting protective layer. In this embodiment, the LED chips and the conductive component are both located in a light-transmitting protective layer so as to form a filament.

Because the substrate in this embodiment is the strip-shaped or spiral substrate, with a small width and an elongate shape. If necessary, both sides of the substrate are provided with the light-transmitting protective layer, or the whole substrate is located in the light-transmitting protective layer, so that an overall structure of the filament is more unified and beautiful.

In the above, the light-transmitting protective layer can be transparent, opaque or translucent, as long as it meets light-transmitting requirements. For example, a fluorescent glue can be used, which is not particularly limited.

Embodiment 12

Figure 12:
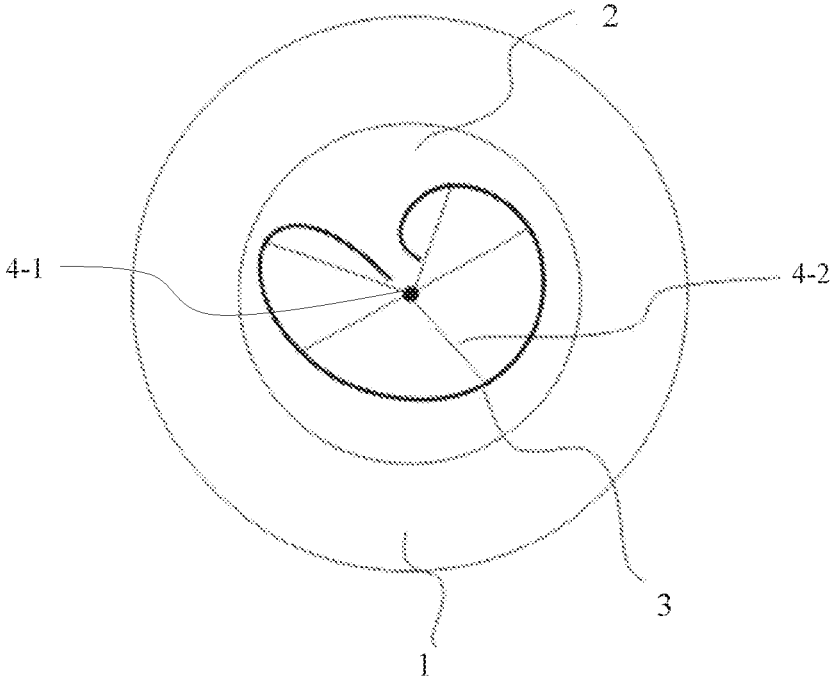
FIG. 12 is a schematic diagram of a ceiling lamp disclosed in Embodiment 12.

This embodiment discloses a ceiling lamp. As shown in FIG. 12, a structure of the ceiling lamp is different from that in Embodiment 7 in that its light source 3 includes one filament with a curved structure.

Specifically, a bracket is fixed to the lamp base, and the bracket fixes the filament of the curved structure. The bracket includes a first bracket 4-1, specifically in a form of a straight rod, with one end being fixed to the lamp base and the other end being far away from the lamp base.

The bracket further includes a second bracket 4-2. The second bracket is in a form of a plurality of elongate fixing wires, and one ends of the fixing wires are fixed to the first bracket and the other ends of the fixing wires are connected with the filament, so that the filament can be molded by the plurality of fixing wires, and then different styles of light sources can be designed. The fixing wires can be copper wires, iron wires, nickel wires, or molybdenum wires. The fixing wires can be rigid or semi-flexible (that is, it can be shaped), instead of being made of completely soft material.

Embodiment 13

Figure 13:
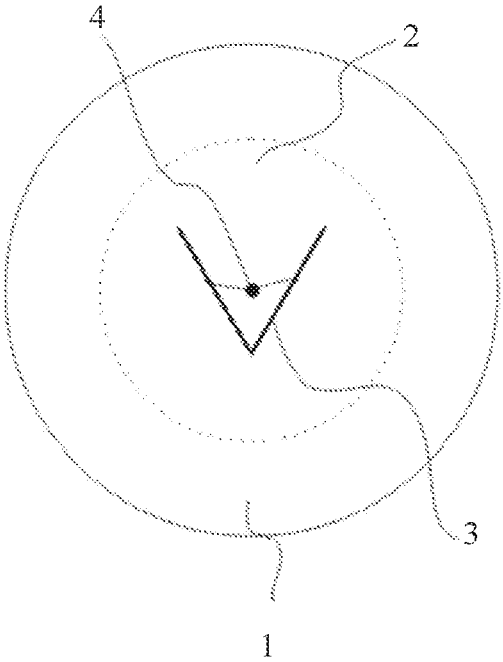
FIG. 13 is a schematic diagram of a ceiling lamp disclosed in Embodiment 13.

This embodiment discloses a ceiling lamp. As shown in FIG. 13, a structure of the ceiling; lamp is different from that in Embodiment 7 in that its light source 3 includes one filament with a bent structure.

Embodiment 14

Figure 14:
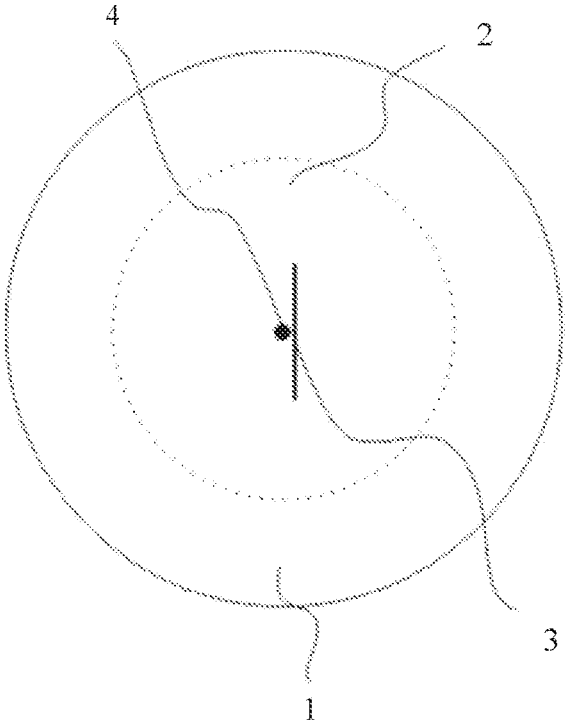
FIG. 14 is a schematic diagram of a ceiling lamp disclosed in Embodiment 14.

This embodiment discloses a ceiling lamp, as shown in FIG. 14, a structure of this ceiling lamp is different from that in Embodiment 7 in that its light source 3 includes one filament which is a flexible filament and is stretched to be a straight rod structure. The flexible filament of this straight rod structure is fixed transversely or vertically or obliquely in the light-transmitting lampshade.

Other parts of the ceiling lamp are shown in Embodiment 7, and will not be described in detail here. Design and adjustment can be made by those skilled in the art according to the above.

In other embodiments, the downlight includes two, three, four or more filaments in a straight rod structure. A plurality of filaments with a straight rod structure are vertically or transversely or obliquely arranged in the first cavity.

Embodiment 15

Figure 15:
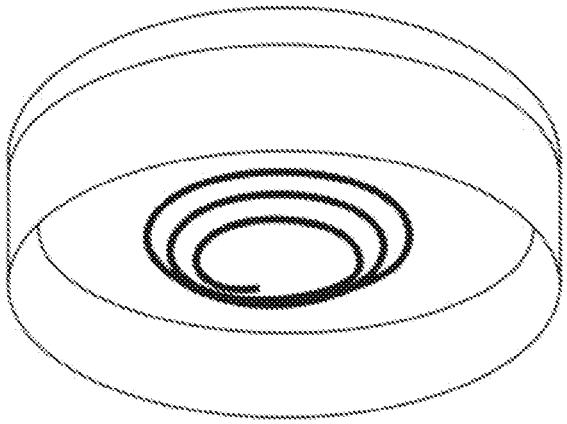
FIG. 15 is a schematic diagram of a ceiling lamp disclosed in Embodiment 15.

In this embodiment, a ceiling lamp is disclosed, which does not use a bracket to fix the filament, and the filament is mounted in the first cavity. There are one or more filaments, each including one or more of a straight rod structure, a curved structure, a bent structure, a spiral structure and a winding structure, as shown in FIG. 15.

As shown, taking a filament with a spiral structure as an example, a part of the filament with the spiral structure is fixed to the lamp base and directly fixed to the first cavity without a bracket, and the power supply end is connected to the lamp base.

In an embodiment, a part of the filament is fixed to the lamp base, and when the ceiling lamp is mounted to the wall, unfixed parts of the filament droop due to gravity, forming a uniquely designed ceiling lamp light source.

In another embodiment, the filament adopts a semi-flexible or rigid substrate, and when the filament is shaped in the first cavity, it will not be deformed due to the gravity.

The mounting method disclosed in Embodiment 15 can be applied to any one of the ceiling lamps in Embodiments 7-14, as long as the bracket in Embodiments 7-14 is replaced by the mounting method of this embodiment.

Further, the LED chips described in embodiment 11 refer to bare chips, while the LED chips described in embodiments 7 to 14 above can specifically refer to bare chips or LED lamp beads.

Although the downlights and ceiling lamps are exemplified above, the lamps in this application include but are not limited to the downlights and ceiling lamps.

In addition, it should be noted that the specific embodiments described in this specification may have different shapes, names or the like of parts and components. Equivalent or simple changes made in accordance with the configurations, features and principles described in the inventive concept are included in the scope of protection of the disclosure. Various modifications, supplements or similar replacements can be made to the described specific embodiments by those skilled in the art to which the present disclosure pertains, which fall within the protection scope of the present disclosure without departing from the structure of the present disclosure or beyond the scope defined by the claims.

What is claimed is:

1. A lamp, comprising a lamp body, a light-transmitting part and a light source, wherein the light-transmitting part is mounted to the lamp body, and the lamp body comprises a lamp base, the light source is mounted between the lamp base and the light-transmitting part directly or mounted in a first cavity formed between the light-transmitting part and the lamp base, and the light source comprises at least one filament which is completely or partially suspended relative to the lamp base; the lamp is a downlight or ceiling lamp;

wherein the lamp base comprises a first bottom plate and a mounting part, the first cavity is arranged between the light-transmitting part and the first bottom plate;

wherein the lamp base further comprises a second bottom plate, a second cavity is provided between the first bottom plate and the second bottom plate, and the first bottom plate and the second bottom plate are connected.

2. The lamp according to claim 1, wherein the light source comprises one or more of a straight rod structure, a curved structure, a bent structure, a spiral structure and a winding structure.

3. The lamp according to claim 2, wherein the light source comprises one or more of a straight rod structure, a curved structure, a bent structure, a spiral structure and a winding structure composed of one filament; or the light source comprises one or more of a straight rod structure, a curved structure, a bent structure, a spiral structure and a winding structure composed of two or more than two filaments.

4. The lamp according to claim 1, further comprising a bracket, wherein the filament is suspended or partially suspended and fixed between the lamp base and the light-transmitting part or in the first cavity by the bracket.

5. The lamp according to claim 4, wherein the bracket comprises a first bracket which is connected with and fixes the filament, with an end of the filament being fixed to the lamp base.

6. The lamp according to claim 5, wherein the light source comprises a driving circuit and a power supply end.

7. The lamp according to claim 5, wherein the light source is connected with a driving circuit, and the driving circuit is mounted at the lamp body or located outside the lamp body.

8. The lamp according to claim 7, wherein the driving circuit is mounted on the lamp base.

9. The lamp according to claim 5, wherein a mounting part is mounted outside the lamp body.

10. The lamp according to claim 5, wherein the bracket further comprises a second bracket, an end of the second bracket is connected with the first bracket, and the other end thereof is connected with the filament.

11. The lamp according to claim 10, wherein the first bracket and the second bracket are independently fixed to the lamp base.

12. The lamp according to claim 1, wherein the filament is fixed to the lamp base, all of the filament is fixed to the lamp base, or part of the filament is fixed to the lamp base.

13. The lamp according to claim 1, wherein the filament comprises at least one luminescent particle and at least two sections of conductive components.

14. The lamp according to claim 13, wherein the at least one luminescent particle is a LED chip or a LED lamp bead.

15. The lamp according to claim 14, wherein the filament further comprises a substrate on which the at least luminescent particle is mounted; wherein the substrate is a flexible substrate or a rigid substrate.

16. The lamp according to claim 1, wherein the mounting part has a lamp fixing structure.

17. The lamp according to claim 1, wherein a surface of the first bottom plate located in the first cavity is a reflective surface.

18. The lamp according to claim 1, wherein the first bottom plate and the second bottom plate are connected by a buckle; and the buckle comprises a stepper component.

19. The lamp according to claim 1, wherein the lamp is a downlight or ceiling lamp; when the lamp is the downlight, the light-transmitting part is a light-transmitting plate; and when the lamp is the ceiling lamp, the light-transmitting part is a light-transmitting lampshade.

* * * * *